US012332007B2

(12) United States Patent
Montgomery

(10) Patent No.: US 12,332,007 B2
(45) Date of Patent: Jun. 17, 2025

(54) TRIGGER BLOCK

(71) Applicant: James Montgomery, Delta, CO (US)

(72) Inventor: James Montgomery, Delta, CO (US)

( * ) Notice: Subject to any disclaimer, the term of this patent is extended or adjusted under 35 U.S.C. 154(b) by 0 days.

(21) Appl. No.: 18/343,394

(22) Filed: Jun. 28, 2023

(65) Prior Publication Data

US 2024/0003643 A1 Jan. 4, 2024

Related U.S. Application Data

(60) Provisional application No. 63/356,622, filed on Jun. 29, 2022.

(51) Int. Cl.
*F41A 17/54* (2006.01)

(52) U.S. Cl.
CPC ..... *F41A 17/54* (2013.01)

(58) Field of Classification Search
CPC ..... F41A 17/54
See application file for complete search history.

(56) References Cited

U.S. PATENT DOCUMENTS 2,512,140 A * 6/1950 Childs ..... F41A 17/54 42/70.07
3,392,471 A * 7/1968 Foote ..... F41A 17/02 42/70.07
3,624,945 A * 12/1971 Foote ..... F41A 17/02 42/70.07
3,711,979 A * 1/1973 Small ..... F41A 17/54 42/70.07
4,499,681 A * 2/1985 Bako ..... E05B 67/36 42/70.07
4,723,370 A * 2/1988 Sheehan ..... F41A 17/54 42/70.07
5,544,440 A * 8/1996 Stockman ..... F41A 17/54 42/70.07
5,647,158 A * 7/1997 Eskelinen ..... F41A 17/54 42/70.07
5,704,152 A * 1/1998 Harrison ..... F41A 17/04 42/70.07
5,832,647 A * 11/1998 Ling ..... F41A 17/54 42/70.07
5,899,102 A * 5/1999 Ling ..... F41A 17/54 42/70.07
6,308,540 B1 * 10/2001 Lee ..... E05B 73/0005 42/70.07
6,405,469 B1 * 6/2002 Walsh ..... F41A 17/02 42/70.07
6,722,071 B1 * 4/2004 Lin ..... F41A 17/02 42/70.07
10,048,032 B1 * 8/2018 Lazar ..... F41A 17/44
2016/0061547 A1 * 3/2016 Farr ..... F41A 17/54 42/70.06

FOREIGN PATENT DOCUMENTS

CA 2330507 A1 * 7/2001 ..... F41A 17/54
WO WO-9835201 A1 * 8/1998 ..... F41A 17/54

* cited by examiner

*Primary Examiner* — Jonathan C Weber
(74) *Attorney, Agent, or Firm* — Leyendecker & Lemire, LLC

(57) ABSTRACT

A plurality of trigger blocks are described. Embodiments of the trigger block can be implemented as a collapsible trigger block adapted to shroud a trigger to aid in preventing accidental discharges of a firearm. The collapsible trigger block can implement a linear ratchet assembly and a stop to secure the collapsible trigger block inside a trigger guard of a firearm.

20 Claims, 14 Drawing Sheets

TRIGGER BLOCK

CROSS-REFERENCE TO RELATED APPLICATION

This application claims the benefit of U.S. Provisional Application No. 63/356,622, filed Jun. 29, 2022.

BACKGROUND

Currently available devices for preventing accidental discharges of a firearm include devices designed to either prevent trigger movement or completely restrict access to the trigger without unlocking the device. These devices are successful in preventing accidental discharges, but are often cumbersome and time consuming to use in an emergency. Several devices require a key to remove the trigger lock and generally are not meant for use when a person is carrying the firearm. Devices that block a movement of the trigger alter a use of the firearm and are often times easily removed. This can lead to accidental discharges by pets and children.

A device configured to reduce accidental discharges of a firearm without altering a functionality of the firearm and being able to be removed quickly is needed.

DETAILED DESCRIPTION

Figure 1:
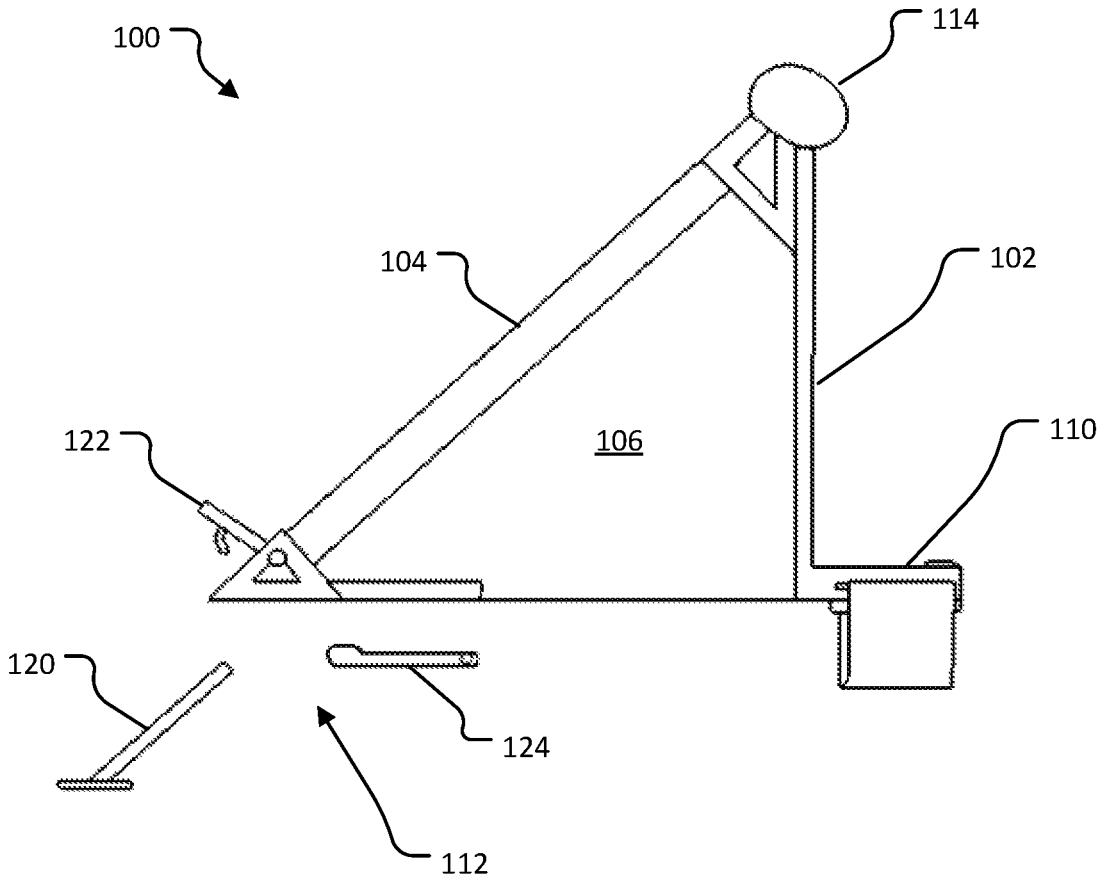
FIG. 1 is a side view of a trigger block according to one embodiment of the present invention.

Embodiments of the present invention include trigger blocks adapted to restrict access to a trigger by shrouding the trigger. The trigger blocks can be implemented to guard against accidental discharges of a firearm. In one instance, the trigger block can be overcome by applying sufficient force to break a pair of vertically oriented breakable members of a breakable trigger block. In another instance, the trigger block can be removed by engaging a release member of a collapsible trigger block. In yet another instance, the trigger block can be overcome by breaking horizontally oriented pin members of a slide trigger block. In some instances, a user can access an interior of the trigger guard in front of the trigger to allow for a finger to pass through the trigger guard when the trigger block is installed. One embodiment of the trigger block can be configured to effectively cover a trigger and the open area in front of the trigger inside the trigger guard.

Of significant note, embodiments of the trigger block can be implemented so as not to interfere with a normal action of a trigger or functionality of a firearm. More specifically, when the trigger block is installed, a user may still chamber, load, and unload the firearm. As can be appreciated, a trigger typically moves during these processes and the trigger block may not directly interface or prevent movement of the trigger or interfere with the operation of a safety mechanism of the firearm.

Embodiments of the trigger block can be implemented to wrap around (e.g., shield or shroud) a trigger while allowing for normal movement of the trigger while protecting the trigger. The trigger block can implement a pressurized adjustable and/or moldable bracing method for securing the trigger block in place. Some embodiments can implement a stop that can be pre-fabricated, adjustable, or interchangeable such that a predetermined force needs to be applied to overcome the stop and activate a release of the bracing means. In one embodiment, the trigger block can implement a four fixing apparatus that can lock the bracing means in place and cannot be accessed in the fixed position. As can be appreciated, the stop would need to be overcome and the release activated in order to remove the trigger block.

Embodiments of the trigger block can be configured such that they are relatively tamper proof from tools and simple lockpicks (e.g., paperclips, wires, screwdrivers, etc.) that a child might use to try and remove the trigger block. In general, the trigger block can be implemented to require adult strength and/or proper strength or skill to remove the trigger block. As stated previously, the trigger block can be implemented to prevent potential unwanted use, accidental discharge, etc. from pets, debris, and a resting trigger finger. Further, the trigger block can implement components that may only be accessible from inside the trigger block specifically prior to installment or after being released and removed. In some instances, components can be altered or changed prior to installation to change an operation of the trigger block. For instance, breakable members requiring a stronger force to break can be swapped for breakable members having a lesser force to break.

Embodiments of a breakable trigger block are contemplated where the breakable member can be swapped out for a different breakable member with a different force required to break the breakable member. Similarly, embodiments of a slide trigger block are contemplated where the pin members can be selected based on a force necessary to break the pin members. As can be appreciated, this can allow for a user to customize the force necessary to remove the trigger blocks based on personal preferences.

In one embodiment, a breakable trigger block can include, but is not limited to, a frame, a pair of breakable members, and a pair of sidewalls. The frame can be implemented to secure the trigger block to a trigger guard of a firearm. Typically, the frame can include a first coupling means and a second coupling means. One of the coupling means can be integrated with a locking mechanism to allow for the trigger block to be secured to a trigger guard where removal may only be accomplished by engaging the trigger block and breaking the pair of breakable members or a key can be used to unlock the locking mechanism.

In another embodiment, a collapsible trigger block can include, but is not limited to, a lower frame member, an upper frame member slidably coupled to the lower frame member, a ratchet assembly, and a stop member. The ratchet assembly can be integrated with the lower frame member and the upper frame member. The lower frame member and the upper frame member can be implemented to shroud (or cover) a portion of a trigger inside a trigger guard of a firearm. Of note, the collapsible trigger block can be sized to receive a portion of a trigger therein while leaving an area open in front of the collapsible trigger block and an end of the trigger guard. To install, the upper frame member can be moved down into the lower frame member and the collapsible trigger block can be placed into a trigger guard and then moved to surround a trigger. The upper frame member may then be moved upwards to engage a top of the trigger guard. Of note, as the upper frame member is moved upwards in relation to the lower frame member, the ratchet assembly can be implemented to keep the upper frame member from sliding back down into the lower frame member. The collapsible trigger block can include one or more layers on a top of the upper frame member and on a bottom of the lower frame member to engage with the trigger guard. Instances are contemplated where the one or more layers can be securely pushed against the trigger guard.

In yet another embodiment, a slide trigger block can include, but is not limited to, a first frame member, a second frame member, and a pair of locking members (or pins).

Typically, the first frame member can be configured to mate with the second frame member around a trigger in a trigger guard. The first frame member and the second frame member can each include, but are not limited to, an engagement member, a channel, an upper locking mechanism, and a lower locking mechanism. The engagement member of the first frame member can be adapted to mate with the channel of the second frame. Similarly, the engagement member of the second frame member can be adapted to mate with the channel of the first frame member. When the engagement members are inserted into the channels, the first frame member can be mated to the second frame member. The locking pins can be adapted to restrict the engagement members from disengaging with the locking channels. The upper locking mechanism and the lower locking mechanism can be implemented to secure the slide trigger block to a trigger guard.

In one embodiment, a collapsible trigger block for shrouding a trigger in a trigger guard can include, but is not limited to, a lower frame member, an upper frame member, and a ratchet assembly. The upper frame member can be adapted to slidably couple to the lower frame member. The ratchet assembly can be operatively connected to the upper frame member and located partially in the lower frame member. The ratchet assembly can be adapted to secure the upper frame member in relation to the lower frame member. The lower frame member and the upper frame member can be adapted to shroud the trigger. The ratchet assembly can generally include a linear rack and a pawl operatively connected to the linear rack. The lower frame member can include a stop member adapted to restrict movement of the pawl. In one instance, the lower frame member can include a lower mounting member, a stop member, and a pawl. The upper frame member can include an upper mounting member, a locking member, and a linear rack. The stop member can be implemented to restrict the pawl until a predetermined force is applied to the pawl to overcome the stop member. The upper mounting member can be adapted to rise above a top of the upper frame to engage a firearm and secure the trigger block in place. The locking member can be adapted to lock the upper mounting member in place. When installed on a firearm, the trigger block does not affect an operation of the trigger.

In one embodiment, a collapsible trigger block can include, but is not limited to, a linear ratchet assembly, a lower frame member, an upper frame member, and a stop member. The linear ratchet assembly can include a pawl and a linear rack. The pawl being coupled to the lower frame member. The upper frame member can be slidably coupled to the lower frame member. The linear rack can be coupled to the upper frame member. The stop member can be coupled to the lower frame member and be adapted to block a movement of the pawl. The stop member can have a predetermined breaking force. The lower frame member and the upper frame member can be adapted to shroud at least a portion of a trigger in a trigger guard. A portion of the trigger guard in front of the trigger can remain unblocked when the collapsible trigger block is installed. The linear ratchet assembly can be adapted to fix the upper frame member in place in relation to the lower frame member. A bottom of the lower frame member can be contoured to mate with a trigger guard. The bottom of the lower frame member can include a slip-resistant layer. A top of the upper frame member can include a slip-resistant layer. The pawl can be rotatably coupled to the lower frame member. The upper frame member can be adapted to slide down into the lower frame member when the pawl disengages from the linear rack.

In yet another embodiment, a collapsible trigger block for shrouding a trigger in a trigger guard of a firearm can include, but is not limited to, a linear ratchet assembly, a lower frame member, an upper frame member, and a stop member. The linear ratchet assembly can include a pawl and a linear rack. The pawl can be rotatably coupled to the lower frame member. The upper frame member can be slidably coupled to the lower frame member. The linear rack can be coupled to the upper frame member. The stop member can be coupled to the lower frame member and be adapted to block a movement of the pawl. The lower frame member and the upper frame member can be adapted to shroud the trigger in the trigger guard. The stop member can have a predetermined breaking force where when exceeded the pawl may move freely. The trigger can be accessible when the stop member predetermined breaking force is exceeded.

Described hereinafter is a discussion of examples of components of the collapsible trigger block.

In one embodiment, the linear rack can be defined by a spine having teeth that can allow for height adjustment of the collapsible trigger block. The linear rack can be securely fixed to the upper frame member. The linear rack can be implemented to support a vertical stress holding the collapsible trigger block in place by catching a portion of the pawl upon a selected tooth. The teeth can be spaced appropriately to allow for a top ledge of the support beam to fit between individual teeth of the linear rack. The teeth can be shaped so the surface contacting ledge from beneath can be angled and will pass without catch. Further, the teeth can be shaped so the surface contacting ledge from above can be parallel and will catch and hold the collapsible trigger block open under greater pressure than a designated activation force. Possible embodiments could have the teeth or spine along the sides of upper frame member.

In one embodiment, the pawl can include a lever and a support beam. The support beam can include a horizontal flat ledge configured to intrude far enough to fit the gaps in the teeth of the linear rack. The support beam can be mounted securely and firmly to a solid layer of the lower mounting member and can also be securely fixed to the lower frame member.

The lever can be mounted securely to the lower mounting member such that the lever can pivot about the attachment location. An inner side of the may lever consist of a square (or rectangle) section that when in standard position is parallel vertically with the support beam main shaft so that the ledge of the beam may protrude into teeth of the linear rack without vertical square portion of the lever contacting teeth. A forward outer portion of the lever can have a longer section as the same skew forward at a slight angle and extend down to overlap the stop member on the forward outer side of the stop member. To achieve an activated position, the lever can be passed over the stop member in a rearward direction. This activation will cause the lever to pivot and thus causing the rear of the lever to press inward spanning the distance of the support beam ledge. This may then cause the surface that the linear rack teeth are caught upon to become flush and push the linear rack back slightly. By this elimination of the ledge of the support beam and with nothing for the linear rack teeth to grip, the upper frame member may collapse into the lower frame member. At this point, the collapsible trigger block will be loose and can be removed in a variety of simple means. In some embodiments, the lever may dislodge teeth by squeezing (or separating) the sides of the lower frame member via inserted pins, wires, posts, wedges, or additional shrouds. In some embodiments, the lever can be mounted to the upper frame member.

In one embodiment, the stop member can be a hard lump (or bump) attached firmly to a solid layer of the lower mounting member. The stop member can be implemented to prevent the lever from passing inward in a rear direction without a predetermined amount of force. In one embodiment, the stop member may be directly coupled to the lower mounting member. In another embodiment, the stop member may interchangeable to vary a stiffness of the stop member and adjust a difficulty of overcoming the stop member. The stop member may be a bump, lump, block, tip, post, cone, triangle, pyramid, flange, wedge, angle, snap, clip, lever, fork, spike, cup, dimple, ridge, grate, button, shoe, shoulder, or any type stop shape (or configuration). It is to be appreciated that a location of the stop member can be changed without exceeding a scope of the present invention. For instance, the stop member may be located at a pivot point of the lever, at a top of the support Beam, or on a solid layer of the upper mounting member.

The upper frame member can be configured to slide inside the lower frame member. In one instance, the upper frame member can slide into the lower frame member and can be slightly smaller to fit inside the lower frame member. The lower mounting member can be directly mounted to the lower mounting member. In one instance, the upper mounting member can be directly mounted to the upper frame member. In another instance, the upper frame member can include riser beams that slide down into the upper frame member and allow the upper mounting member to extend (or rise) a small distance (e.g., ~10% of full extended open height). Typically, the lower frame member and the upper frame member can each be closed on three sides to wrap an entire trigger area and protect the trigger from all sides leaving only the rear open. The rear of trigger block can be open to allow for normal functionality of trigger movement during the action of the weapon. All action range of motion for the trigger would be possible within the collapsible trigger block including, but not limited to, loading, unloading, chambering, ejecting, and firing. The collapsible trigger block can be of close enough proximity to the sides of the trigger that virtually nothing could reach behind the trigger and pull on it. In some instance, the lower frame member and the upper frame member can be made from material that can be intended to be clear so the trigger itself may be visible and inspectable for a correct position and/or condition. In one example, the first frame member and the second frame member can be coupled by two or more rails that can be attached to either the lower frame member or the upper frame member. The two or more rails can be implemented to allow the upper frame member to slide up and down within the lower frame member. In general, a range of movement between the upper frame member and the lower frame member can be limited to a minimum of approximately one third span overlap for support and minimal play when fully open.

In one embodiment, the two or more rails can be present on both rear sides of the lower frame member and the upper frame member. It is to be appreciated that the two or more rails may be located on other sides for stability and to hold the lower frame member and upper frame member solid such that only the linear rack flex can release the hold. The rails can have a vertical span equal to a total height when fully closed or collapsed so they may have the greatest coverage for support when open. The rails may have parallel grooves that fit ridges on each of the lower frame member and the upper frame member sides with an appropriate depth to secure the frame members together and allow the necessary expansion and sliding motion. In one embodiment, grooves may be in the frame members and parallel ridges on the rails.

In one embodiment, the upper mounting member can include two layers. A first layer may be a solid layer that may be attached to the upper frame member and other components. The first layer may be an inside layer. A second outer layer can be spongy, cushioned, rubberized, heat sensitive and moldable plastic or rubber or poly material. The second layer can be configured so that with pressure the second layer conforms and grips to the surface of the firearm around where the trigger pivots and enters the action of the weapon (e.g., the manufacturer guard enclosure for the trigger). In some embodiments, the second layer can be designed to grip better with a specific treatment like a powder, adhesive, or a surface prep like a thin layer of grip tape.

The lower mounting member can be similar to the upper mounting member. For instance, the lower mounting member can include a first rigid layer and a second outer layer can be configured so that with pressure the second outer layer can conform and grip to the surface of the firearm around where the trigger pivots and enters the action of the weapon (e.g., the manufacturer guard enclosure for the trigger). In some embodiments, the second layer can be designed to grip better with a specific treatment like a powder, adhesive, or a surface prep like a thin layer of grip tape. Of note, the lower mounting member can be configured to fit a curved (or circular) manufacturer trigger guard enclosure. As can be appreciated, this may involve a curved solid layer and second outer layer while keeping connectivity for components to keep them static.

Riser beams can insert into the upper frame member and couple to the solid layer of upper mounting member. The riser beams can allow for an extra fixing distance of expansion between the upper mounting member and a firearm. In some instances, several riser beams can be placed in positions sufficient to control any sideways twisting motion.

In one embodiment, the collapsible trigger block can include a mechanical assist fixing lock mechanism. Once the fixing lock mechanism is fixed in place, the fixing lock mechanism can accomplish putting pressure needed to hold the collapsible trigger block in place. The mechanical assist fixing lock mechanism can be designed so that once fixed in place it cannot be loosened or unlocked or unfixed without activating the lever with adequate force to overcome the stop member to dislodge the teeth of the linear rack and thus collapsing the collapsible trigger block and removing it. The mechanical assist fixing lock mechanism can only be taken out of proper fixed position with the device removed from the firearm. It is to be appreciated that the lock piece could be a clamp, a swivel, a buckle, a depressor, a snap, a screw, a dial, a switch, a lever, a wedge, a flip, a plunger, a bar, a step, a twist, etc. Embodiments are contemplated for the lock that may include a tool enabled version of any of the above.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

A First Embodiment of a Trigger Block

Figure 2:
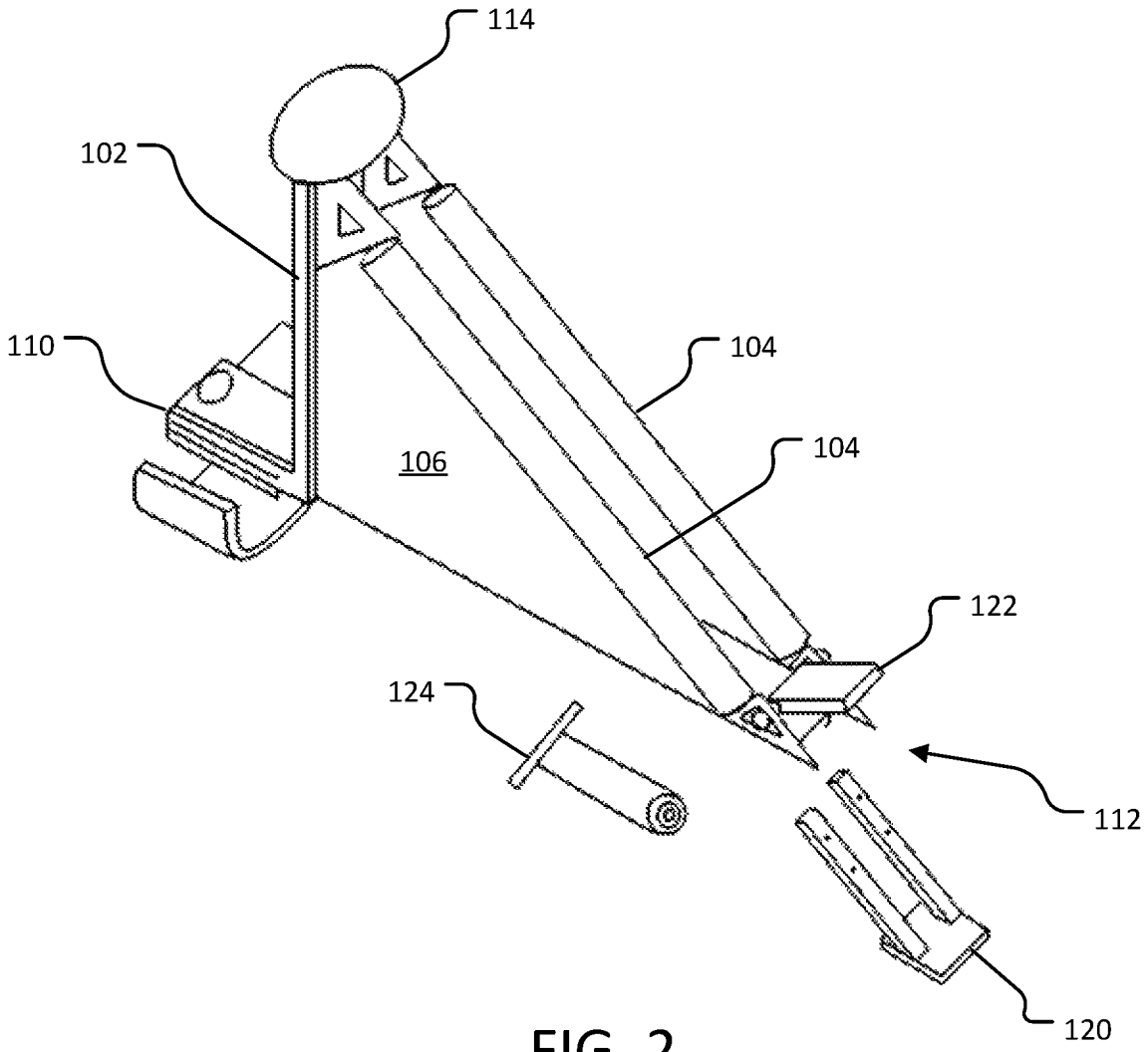
FIG. 2 is a top perspective view of a trigger block according to one embodiment of the present invention.
Figure 3:
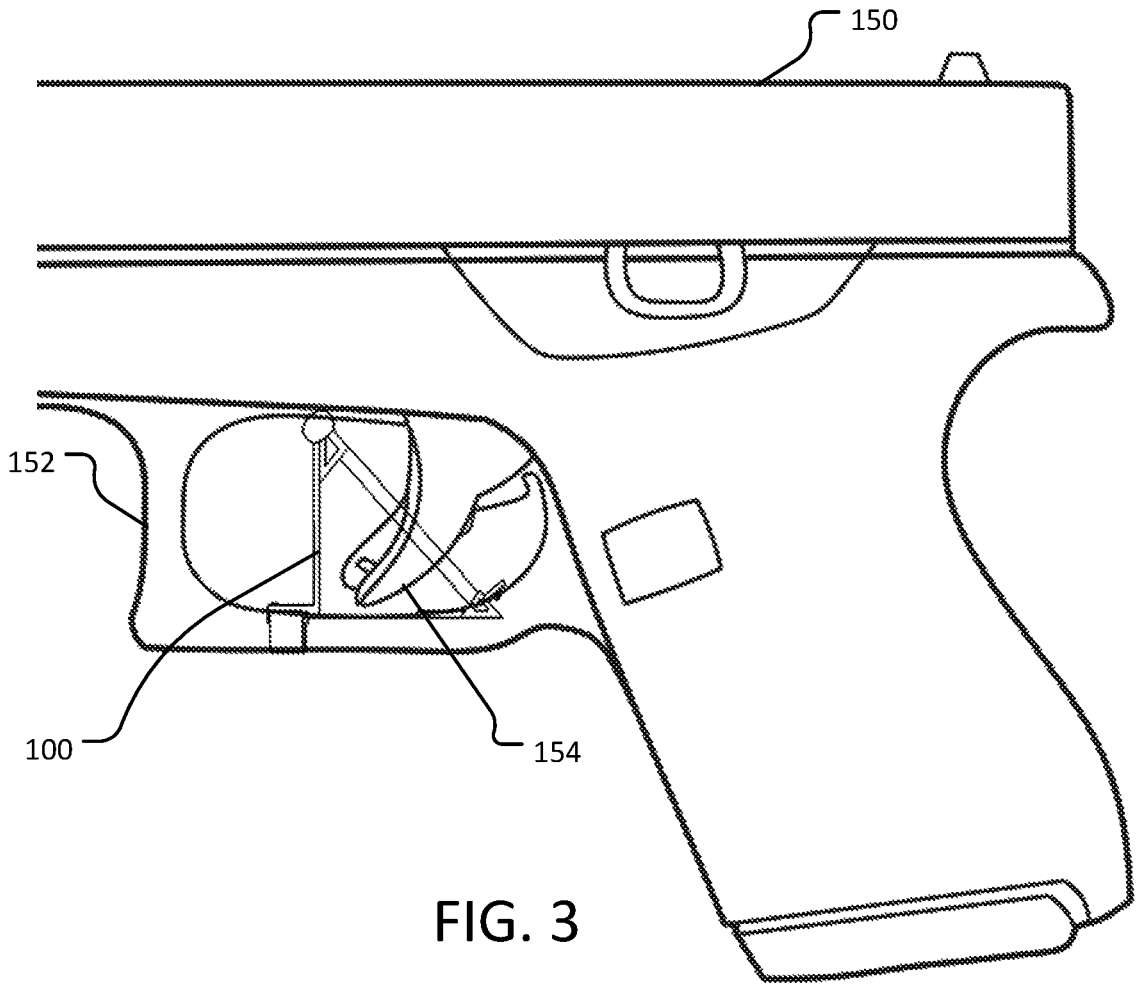
FIG. 3 is a side view of a trigger block installed on a firearm according to one embodiment of the present invention.

Referring to FIGS. 1-3, detailed diagrams of a first embodiment 100 of a trigger block are illustrated. The first embodiment trigger block 100 can be implemented as a breakable trigger block and can be implemented to surround a trigger on at least two sides of the trigger. The breakable trigger block 100 can be implemented to help reduce accidental firings of a firearm and can include a breakable design to allow access to a trigger when required. Of note, a functionality of a firearm implementing the breakable trigger block 100 may not be altered, only means for restricting access to the trigger can be in place to make it harder to engage the trigger and depress the trigger to fire the firearm.

Referring to FIG. 3, the breakable trigger block 100 is shown installed in a firearm 150. The breakable trigger block 100 can be installed in a trigger guard 152 of the firearm 150 and can be implemented to shroud a trigger 154 of the firearm. Of note, a functionality of the trigger 154 may not be affected by the breakable trigger block 100 allowing for cycling of the action of the firearm 150. For instance, the firearm may still be loaded, unloaded, etc. with the breakable trigger block 100 installed.

As generally shown in FIGS. 1-3, the breakable trigger block 100 can include, but is not limited to, a frame 102, a pair of breakable members 104, and a pair of sidewalls 106. The frame 102 can be implemented to secure the breakable trigger block 100 to a trigger guard 152 of a firearm 150. The pair of breakable members 104 can be implemented to provide a predetermined amount of force needed to break the members 104 so that a trigger 154 may be engaged. The pair of sidewalls 106 can be implemented to surround and block access to the trigger 154 from sides of the trigger block 100.

The frame 102 can typically include a first attachment means 110, a second attachment means 112, and an engagement member 114. The first attachment means 110 can be adapted to secure a front lower portion of the frame 102 to the trigger guard 152. The second attachment means 112 can be implemented to secure a rear lower portion of the frame 102 to the trigger guard 152. The engagement member 114 can be implemented to engage and stabilize an upper front portion of the frame 102 to the trigger guard 154. The first attachment means 110 can be implemented for backwards and forwards stabilization and the engagement member 114 can typically be implemented for lateral stabilization inside the trigger guard. As can be appreciated, when a user engages and pulls a front of the frame 102, the force can be translated to the breakable members 104 which can break when sufficient force is applied.

Typically, the first attachment means 110 can be an attachment means allowing for an adjustability in how strong the attachment means is secured to the trigger guard 152. In one instance, the first attachment means 110 can be a reusable cinch strap allowing for the cinch strap to be tightened about the trigger guard 152. In some instances, a mechanical tightening mechanism can be implemented to secure and tighten the cinch strap. For instance, a ratchet style mechanism may be implemented. In other instances, a simple cinch strap implementing a buckle and hook and loop closure material may be implemented.

The second attachment means 112 can include a removable member 120, a locking clamp 122, and a key 124. The locking clamp 122 can be implemented to interface with the removable member 120 and secure the removable member 120 about a trigger guard. The key 122 can be implemented to unlock the locking clamp 122. To secure the second attachment means 112 to a trigger guard, the removable member 120 can be separated from the frame 102 as the breakable trigger block 100 is positioned in a trigger guard of a firearm. Once the breakable trigger block 100 is positioned correctly, the removable member 120 can be placed around the trigger guard and inserted into the frame 102. The locking clamp 122 may then be engaged to lock the removable member 120 in place. To remove the breakable trigger block 100, the key 124 can be inserted to separate the locking clamp 122 from the frame 102 so that the removable member 120 can be removed.

Typically, embodiments of the breakable trigger block 100 can be implemented as a one-use device in case of an emergency. Of note, the breakable members 104 can generally be oriented at a 450 angle and can be brought to specifications based on a need of a user. In some instances, the frame 102 and the sidewalls 106 can be scored (or perforated) so that when the breakable members 104 break, the other components can snap clean into a few pieces. The components would then fall away leaving only the mount still in place and the trigger accessible and usable. Since the breakable trigger block 100 can be intended for single use, the removable member 120 and key 124 can be implemented to allow for removal of the breakable trigger block 100 before a planned use of the firearm.

A Second Embodiment of a Trigger Block

Referring generally to FIGS. 4-7, detailed diagrams of a second embodiment 200 of a trigger block is illustrated. The second embodiment trigger block 200 can implement a ratchet assembly to allow for the second embodiment trigger block 200 to be collapsible after installation. More specifically, the collapsible trigger block 200 can collapse when a sufficient force is applied to the ratchet assembly. The collapsible trigger block 200 can surround (or shroud) a trigger on at least two sides while still allowing access through a trigger guard in front of the trigger. Of significant note, the collapsible trigger block 200 can be configured to be reusable.

Figure 4:
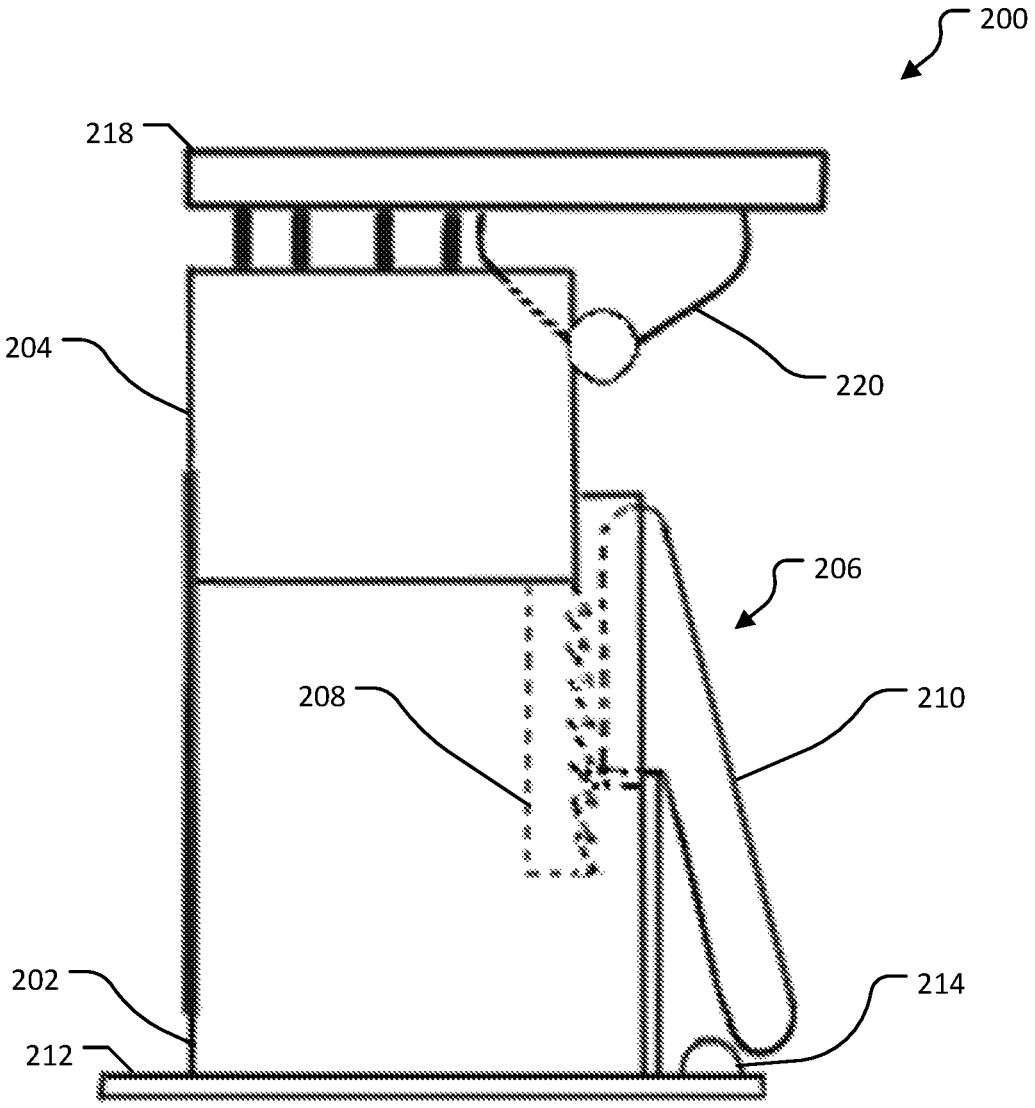
FIG. 4 is a side view of a trigger block according to one embodiment of the present invention.

As shown in FIG. 4, the collapsible trigger block 200 can include, but is not limited to, a lower frame member 202, an upper frame member 204, and a ratchet assembly 206. The upper frame member 204 can be slidably coupled to the lower frame member 202. For instance, the upper frame member 204 can move in relation to the lower frame member 202 while the lower frame member 202 remains static. In one example, the upper frame member 204 can start substantially within the lower frame member 202 and be moved upwards to adjust an overall height of the collapsible trigger block 200. The ratchet assembly 206 can be implemented to secure a position of the upper frame member 204 in relation to the lower frame member 202.

The ratchet assembly 206 can typically include a linear rack 208 and a pawl 210. The ratchet assembly 206 can be implemented to adjust and lock a height of the upper frame member 204 in relation to the lower frame member 202. As can be appreciated, the ratchet assembly 206 can be implemented to fix an overall height of the collapsible trigger block 200. In a typical implementation, the upper frame member 204 can be moved up in relation to the lower frame member 202 and the rachet assembly 206 can secure a height of the upper frame member 204 in relation to the lower frame member 202.

Figure 5A:
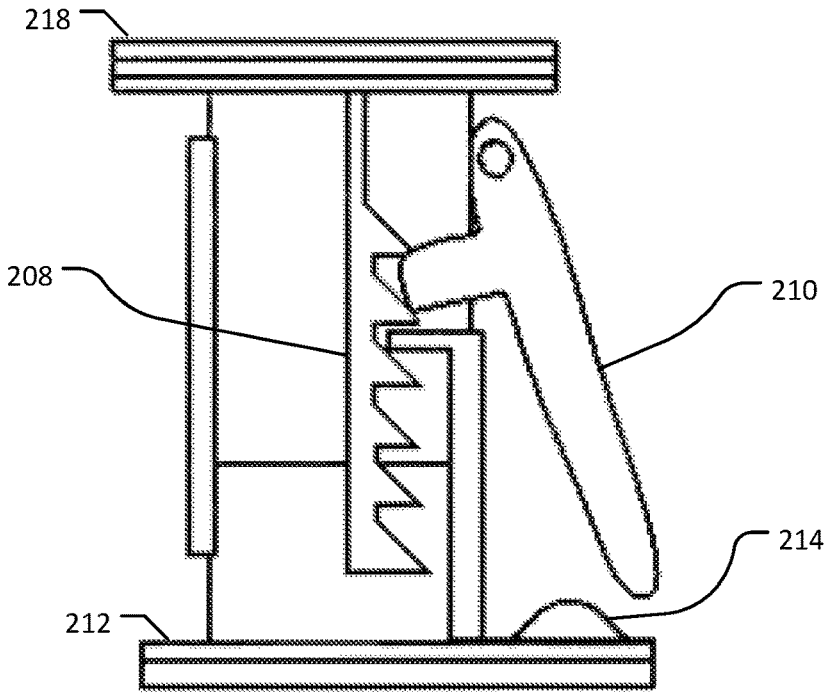
FIG. 5A-5F include several views of a trigger block with a cover removed according to one embodiment of the present invention.
Figure 5B:
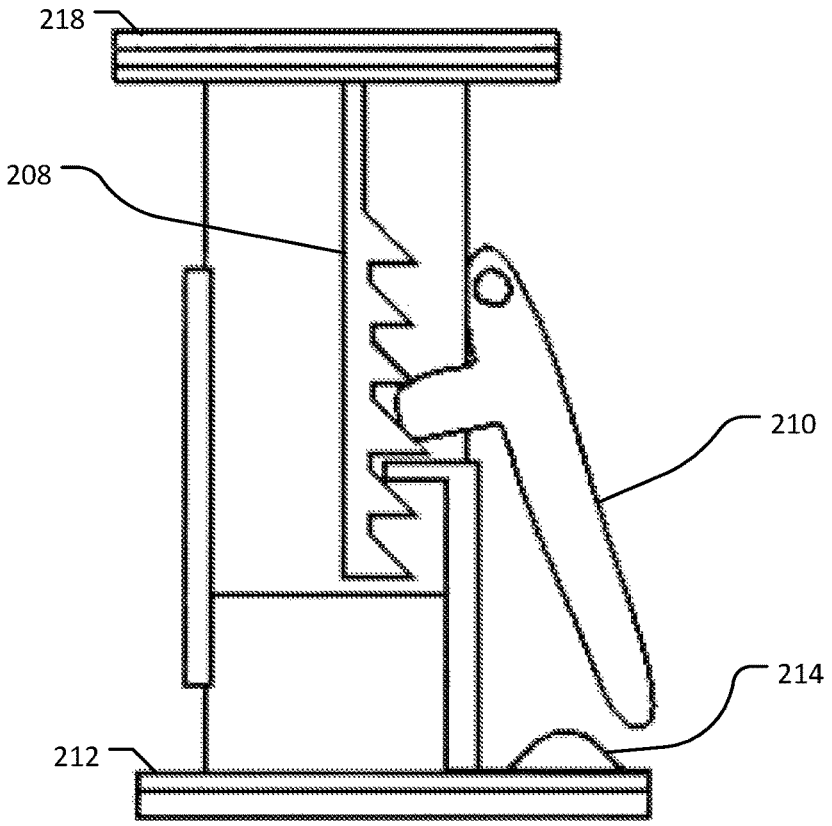
Figure 5C:
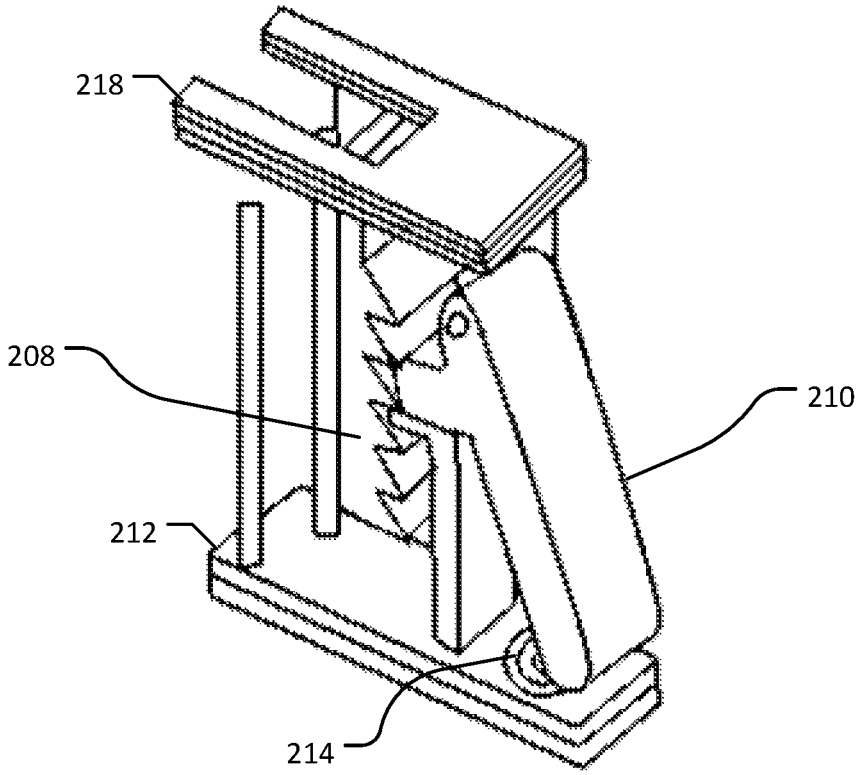
Figure 5D:
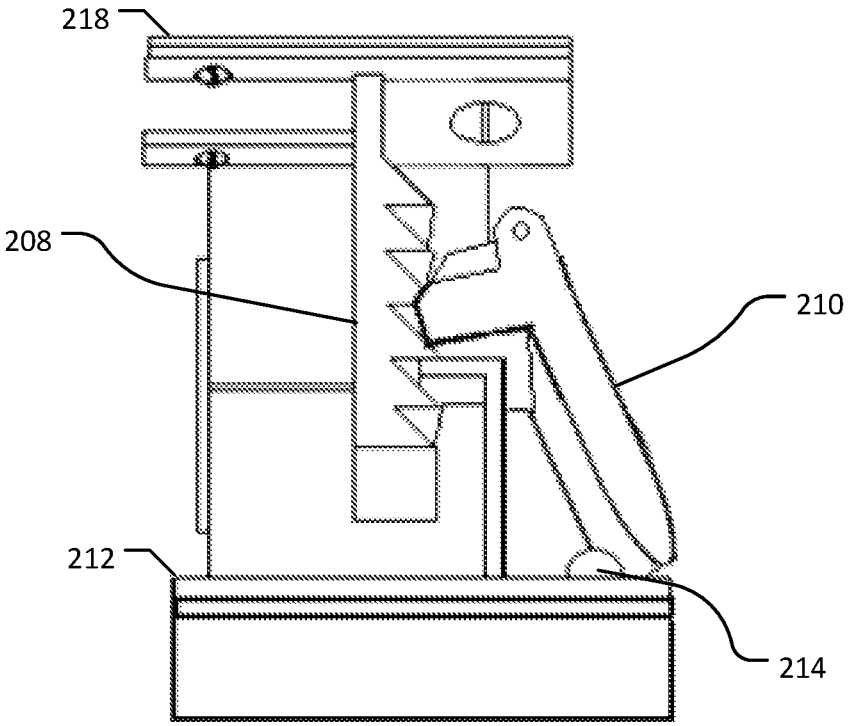
Figure 5E:
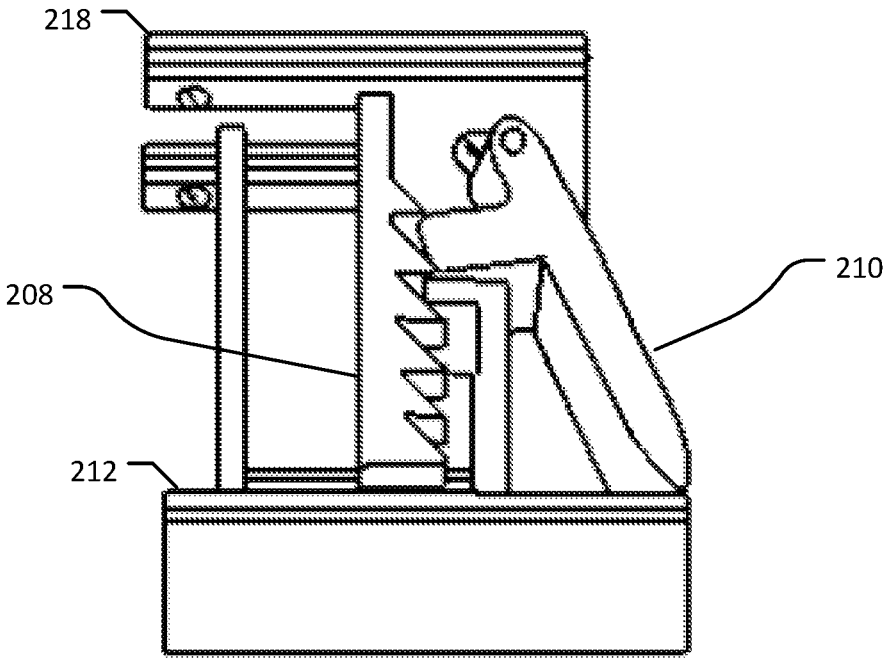
Figure 5F:
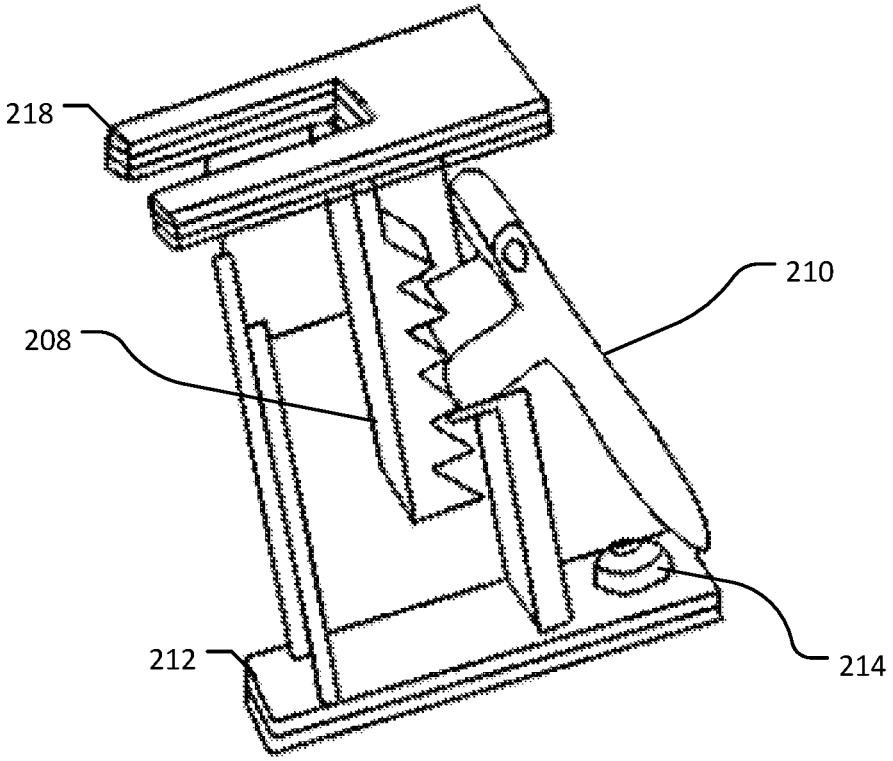

Referring to FIGS. 5A-5F, several views of the collapsible trigger block 200 with walls of the frame members 202/204 removed are shown. FIG. 5A shows the collapsible trigger block 200 in a collapsed configuration. FIG. 5B shows the collapsible trigger block 200 in an extended configuration. FIG. 5C is a top perspective view of the collapsible trigger block 200. Generally, the lower frame member 202 and the upper frame member 204 can each include a plurality of components to aid securing the collapsible trigger block 200 to a trigger guard.

The lower frame member 202 can include, but is not limited to, a lower mounting member 212, a stop member 214, and the pawl 210 of the ratchet assembly 206. The lower mounting member 214 can be implemented to interface with an interior of a trigger guard. Typically, the lower mounting member 212 can include a layer of flexible material for interfacing with a trigger guard. For instance, rubber, silicone, etc. can be used to manufacture the interfacing layer of the lower mounting member 212. In some embodiments, the lower mounting member 214 may include two or more layers. For instance, a first layer may be a rigid layer and a second exterior layer may be flexible.

The stop member 214 can be implemented to keep the pawl 210 from releasing and allowing the upper frame member 204 to slide down into the lower frame member 202. In some instances, the stop member 214 can be integral to the lower mounting member 212. In other instances, the stop member 214 can be coupled to the lower mounting member 212. In one example, and as shown, the stop member 214 may be a nubbin protruding upwards from the lower mounting member 212. The nubbin may protrude out enough to block a movement of the pawl 210. In one example, the stop member 214 may be adapted to break away from the lower mounting member 212. In another example, the stop member 214 may be adapted to compress with enough force applied to the pawl 210 to allow the pawl 210 to pass over the depressed stop member 214. It is to be appreciated that a plurality of means are contemplated to provide an effective blockage of a movement of the pawl 210 and to determine a necessary force to overcome the stop member 214. Typically, the stop member 214 can require a force approximately equal to a grip strength of 3 kg-6 kg to overcome the stop member 214. Of note, 3 kg-6 kg is the grip strength of an average adult index finger where as a child about age ten is typically only capable of less than 3 kg grip strength for an index finger.

The upper frame member 204 can include, but is not limited to, an upper mounting member 218, a locking member 220, and the linear rack 208 of the ratchet assembly 206. The upper mounting member 218 can be implemented to interface with an interior surface of a trigger guard. The locking member 220 can be implemented to push the upper mounting member 218 against the interior surface of the trigger guard and lock the collapsible trigger block 200 in place. In one example, the locking member 220 can be an oblong shaped member adapted to rotate about a fixed location on the upper frame member 204 and engage an underside of the upper mounting member 218 to lock the collapsible trigger guard 200 in place. In another example, the upper mounting member 218 can include two or more layers where fasteners can be implemented to push one or more of the layers up to engage an interior of the trigger guard.

Figure 6:
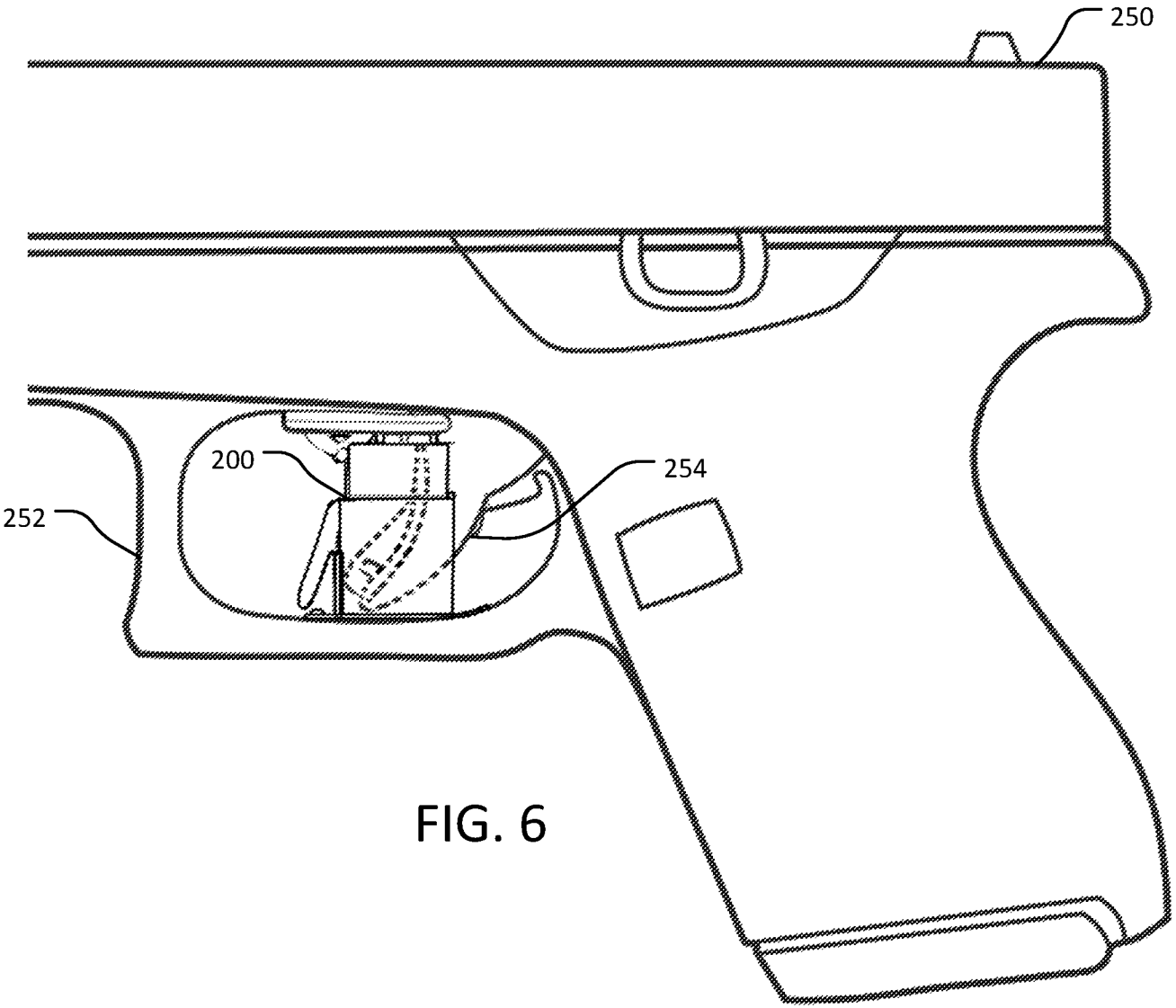
FIG. 6 is a side view of a trigger block installed on a firearm according to one embodiment of the present invention.
Figure 7:
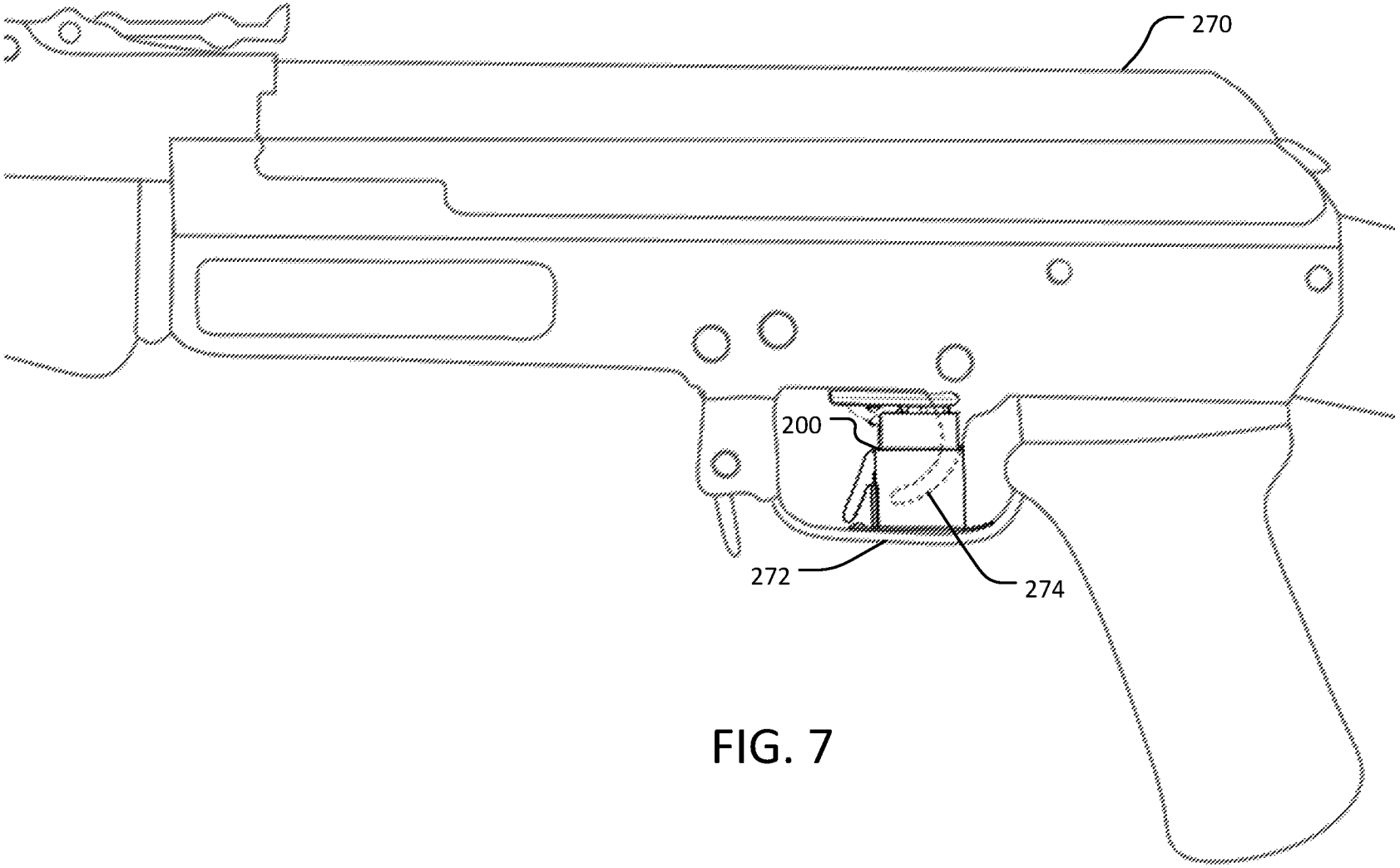
FIG. 7 is a side view of a trigger block installed on a firearm according to one embodiment of the present invention.

Referring to FIGS. 6-7, detailed diagrams of the collapsible trigger block 200 installed in a first firearm 250 and a second firearm 270 are illustrated respectively. The first firearm 250 can include a trigger guard 252 and a trigger 254. The second firearm can include a trigger guard 272 and a trigger 274. As shown, the collapsible trigger block 200 can be implemented to shroud a trigger while leaving access to the trigger guard. As generally shown, an area in front of the collapsible trigger block 200 inside the trigger guards 252/272 is sufficient to allow a user to pass a finger through to engage the pawl 210 of the collapsible trigger block 200.

As shown in FIGS. 6-7, the collapsible trigger block 200 can be sized to shroud a trigger. The lower frame member 202 and the upper frame member 204 can generally include a front wall, a left wall, and a right wall. Of note, embodiments are contemplated where the front wall may not be implemented. A back of the lower frame member 202 and a back of the upper frame member 204 can be open and adapted to receive the trigger. The upper mounting member 218 can also include a slot for receiving a trigger therethrough.

In a typical implementation, the collapsible trigger block 200 can be placed into and in front of a trigger in a trigger guard. The collapsible trigger block 200 can then be moved back to shroud the trigger. Once covering the trigger, the upper frame member 204 can be moved upwards such that the upper mounting member 218 can be engaging an upper inner surface of the trigger guard. Of note, as the upper frame member 204 is moved vertically, the pawl 210 can move along the linear rack 208 to keep the upper frame member 204 from moving downwards. In one example, the pivoting member 220 may then be fully pivoted and locked in place to secure the collapsible trigger block 200 in place.

To disengage the collapsible trigger block 200, a user can pull on the pawl 210. Of note, the stop member 214 can block the pawl 210 from disengaging with the linear rack 208. As such, the user needs to provide sufficient force to the pawl 210 to break (or compress) the stop member 214 and allow the upper frame member 204 to slide down into the lower frame member 202 allowing the collapsible trigger block 200 to be removed.

A Third Embodiment of a Trigger Block

Referring to FIGS. 8-12, detailed diagrams of third embodiment 300 of a trigger block are illustrated. The third embodiment trigger block 300 can implement a pair of slidable locking assemblies to prevent the third embodiment trigger block 300 from being removed after being installed. The slide trigger block 300 can implement a sliding motion along with locking members to prevent access to a trigger of a firearm. Similar to the collapsible trigger block 200, the slide trigger block 300 can be reusable where one component of the trigger block 300 can be replaced after use.

In one embodiment, the slide trigger block 300 can include, but is not limited to, a first frame member 302, a second frame member 304, and a pair of locking members 306. Typically, the first frame member 302 can be configured to mate with the second frame member 304 around a trigger in a trigger guard. As can be appreciated, when mated together, the first frame member 302 and the second frame member 304 can be configured to shroud a trigger in a trigger guard. The locking members 306 can be implemented to keep the first frame member 302 mated to the second frame member 304.

Figure 8:
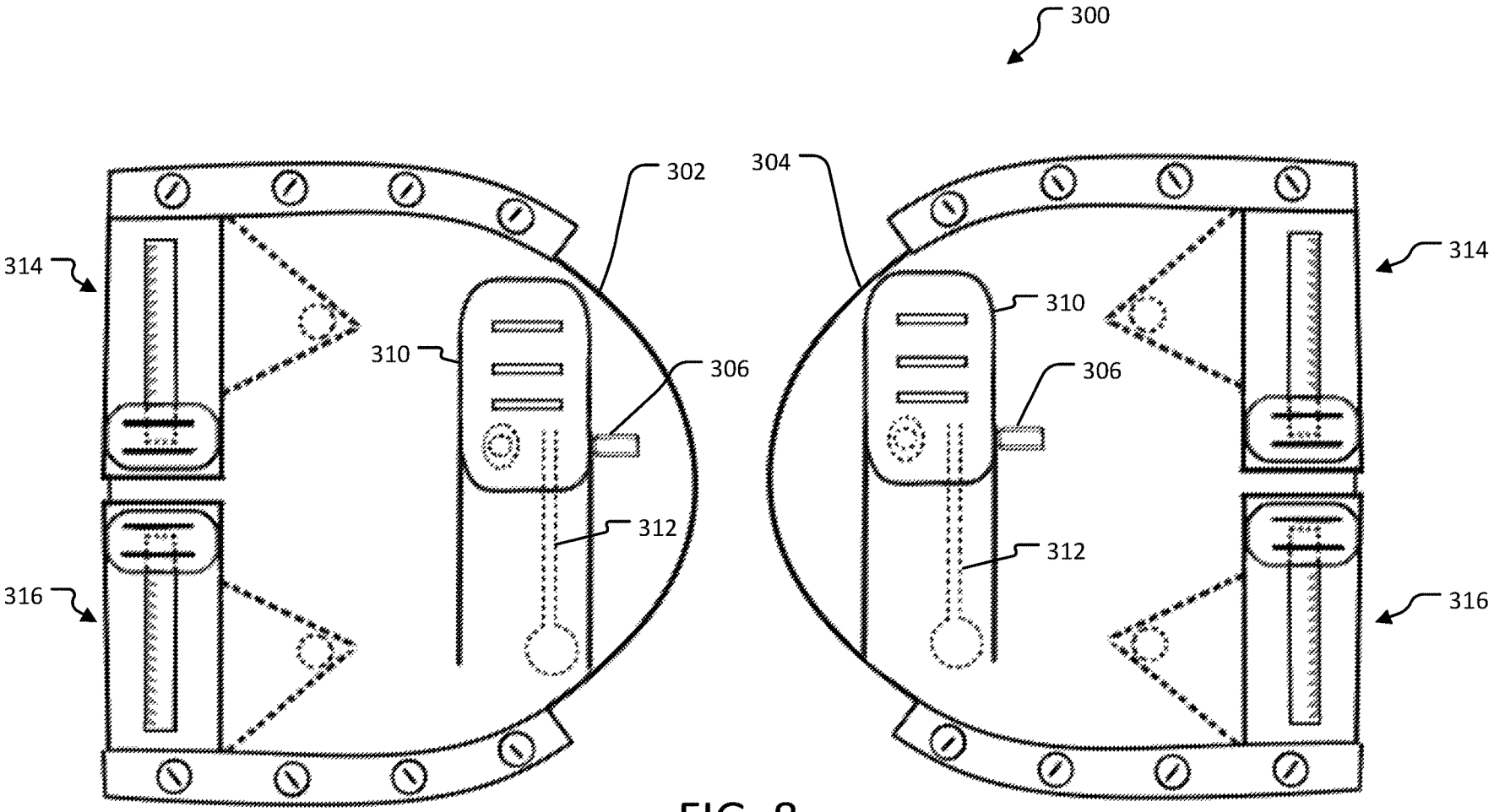
FIG. 8 is a side view of a trigger block according to one embodiment of the present invention.

As shown in FIG. 8, the first frame member 302 and the second frame member 304 can each include, but are not limited to, an engagement member 310, a channel 312, an upper locking mechanism 314, and a lower locking mechanism 316. The engagement member 310 of the first frame member 302 can be adapted to mate with the channel 312 of the second frame member 304. Similarly, the engagement member 310 of the second frame member 304 can be adapted to mate with the channel 312 of the first frame member 302. The locking members 306 can be adapted to keep the engagement members 310 mated with the locking channels 312.

Figure 9:
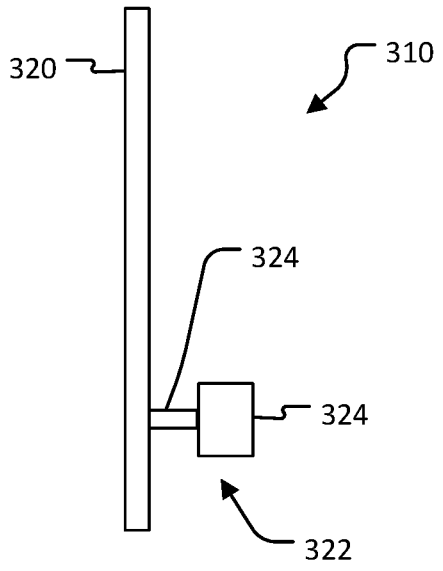
FIG. 9 is a side view of an engagement member of a trigger block according to one embodiment of the present invention.

Referring to FIG. 9, a side view of one example embodiment of the engagement member 210 is shown. Typically, the engagement members 310 can include a plate 320 and a protrusion 322 extending from the plate 320. A first side of the plate can be adapted to interface with a user and be facing outwards in the frame members 302, 304. The protrusion 322 can be located on a second side of the plate 320 and an interior of the frame members 302, 304. The protrusion 322 can typically include a first portion 324 coupled to the second side of the plate 320 and a second portion 326 located proximate a distal end of the protrusion 322. The second portion 326 can be sized larger than the first portion 324 such that the second portion 326 may not pass through an opening of the channels 312 but may pass through the channels 312.

Figure 10:
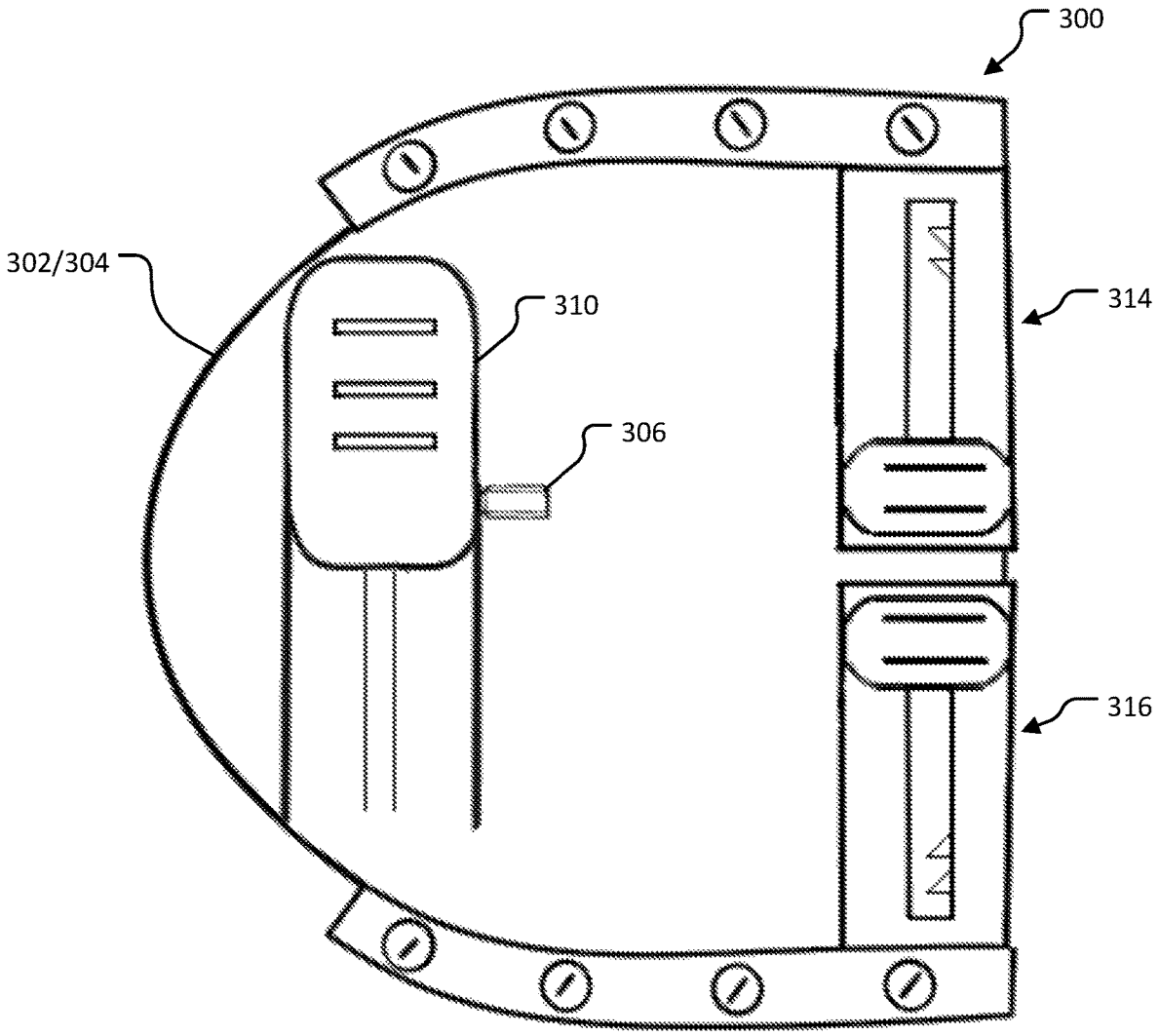
FIG. 10 is a side view of a trigger block according to one embodiment of the present invention.
Figure 11:
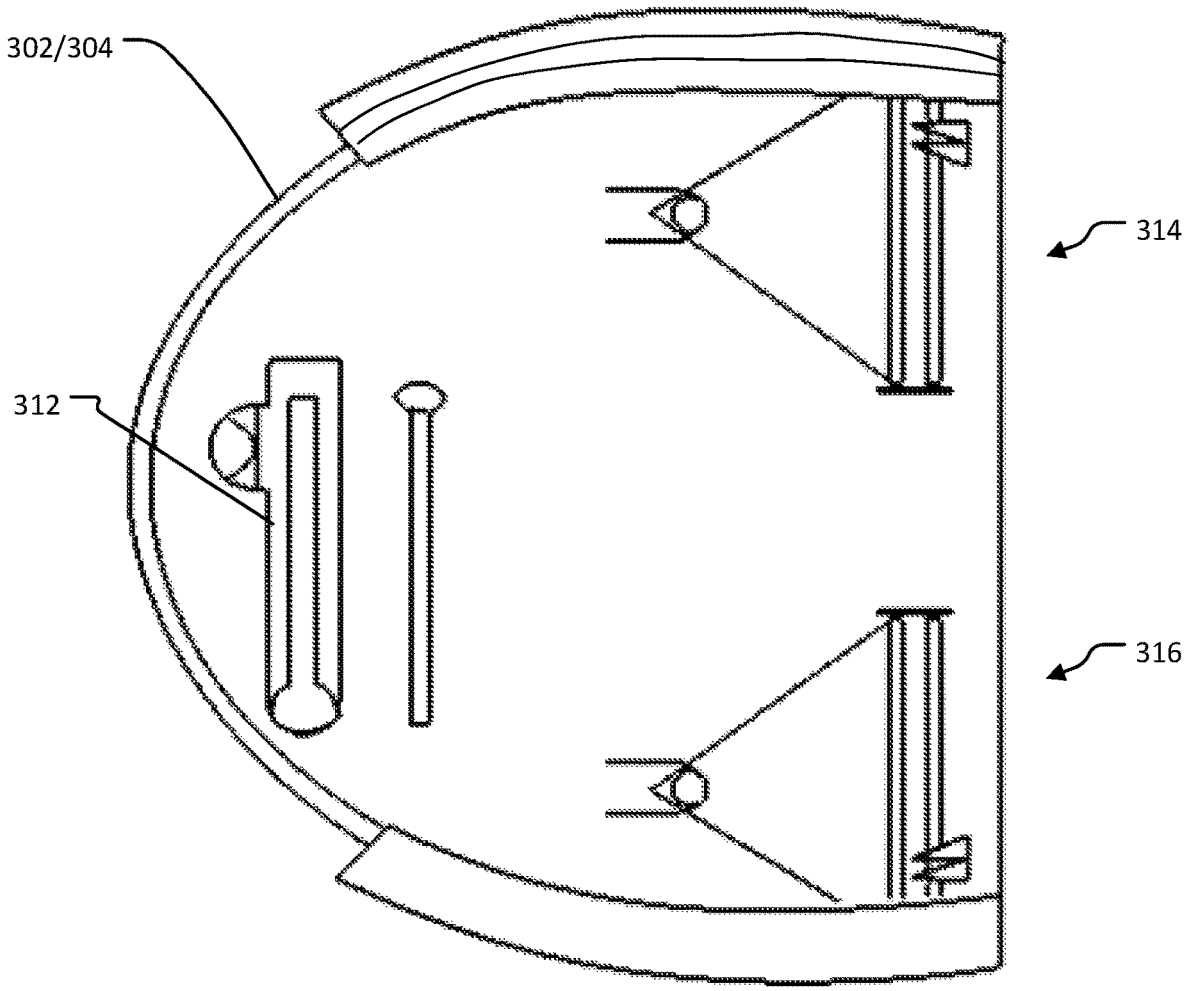
FIG. 11 is a side view of a trigger block showing internal components according to one embodiment of the present invention.

Referring generally to FIGS. 10-11, an exterior view and an interior view of the frame members 302/304 are illustrated, respectively. As shown in FIG. 10, the channel 312 can include an opening at a bottom of the channel 312 that can be sized to receive the second portion 326 of the protrusion 322 therein. The engagement member 310 may then be moved upwards where the first portion 324 of the protrusion 322 can pass through an opening of the channel 312. The second portion 326 of the protrusion 322 can be sized such that the second portion 326 does not pass through the opening of the channel 312. As can be appreciated, this can allow for the first frame member 302 to mate with the second frame member 304 when the protrusions 322 are mated with the channels 312.

To separate the first frame member 302 from the second frame member 304, the engagement members 310 would need to be moved down to the opening of the channels 312 to allow for the frames 302, 304 to separate. As previously mentioned, the locking pins 306 can be implemented to restrict the engagement members 310 from moving down to the opening of the channels 312. More specifically, the locking pins 312 can be inserted into the channels 312 slightly below the engagement member 310 when the engagement member 310 is moved to a top of the channel 312. Typically, the locking pins 312 can be overcome by a force equal to a grip strength of approximately 2.5 kg-5 kg. Of note, 2.5 kg-5 kg is the pinch strength of an average single adult finger index or thumb where a child aged approximately 10 is less than 2.5 kg pinch strength.

As generally shown, the first side of the engagement member 310 can be ribbed (or similar texture) to allow for a user to easily interface with the engagement member 310. As can be appreciated, a user may move the engagement member 310 along a length of the channel 312.

The upper locking mechanism 314 and the lower locking mechanism 316 can be implemented to secure the trigger block 300 to a trigger guard. The locking mechanisms 314, 316 can generally each include a plurality of layers forming an engagement portion of the locking mechanisms 314, 316. The plurality of layers can generally include a first rigid layer, a second rigid layer, and a third flexible (or semi-rigid) layer configured to interface with a trigger guard. As shown, each of the locking mechanisms 314, 316 can include a spring adapted to push the plurality of layers of the locking mechanisms 314, 316 against interior surfaces of the trigger guard. In one example embodiment, as shown, fasteners can be implemented to push the second rigid layer and the third flexible layer upwards (or downwards) to engage the interior of the trigger guard. In one example, one way fasteners can be implemented to prevent an unwanted user to easily remove the slide trigger block 300.

Figure 12:
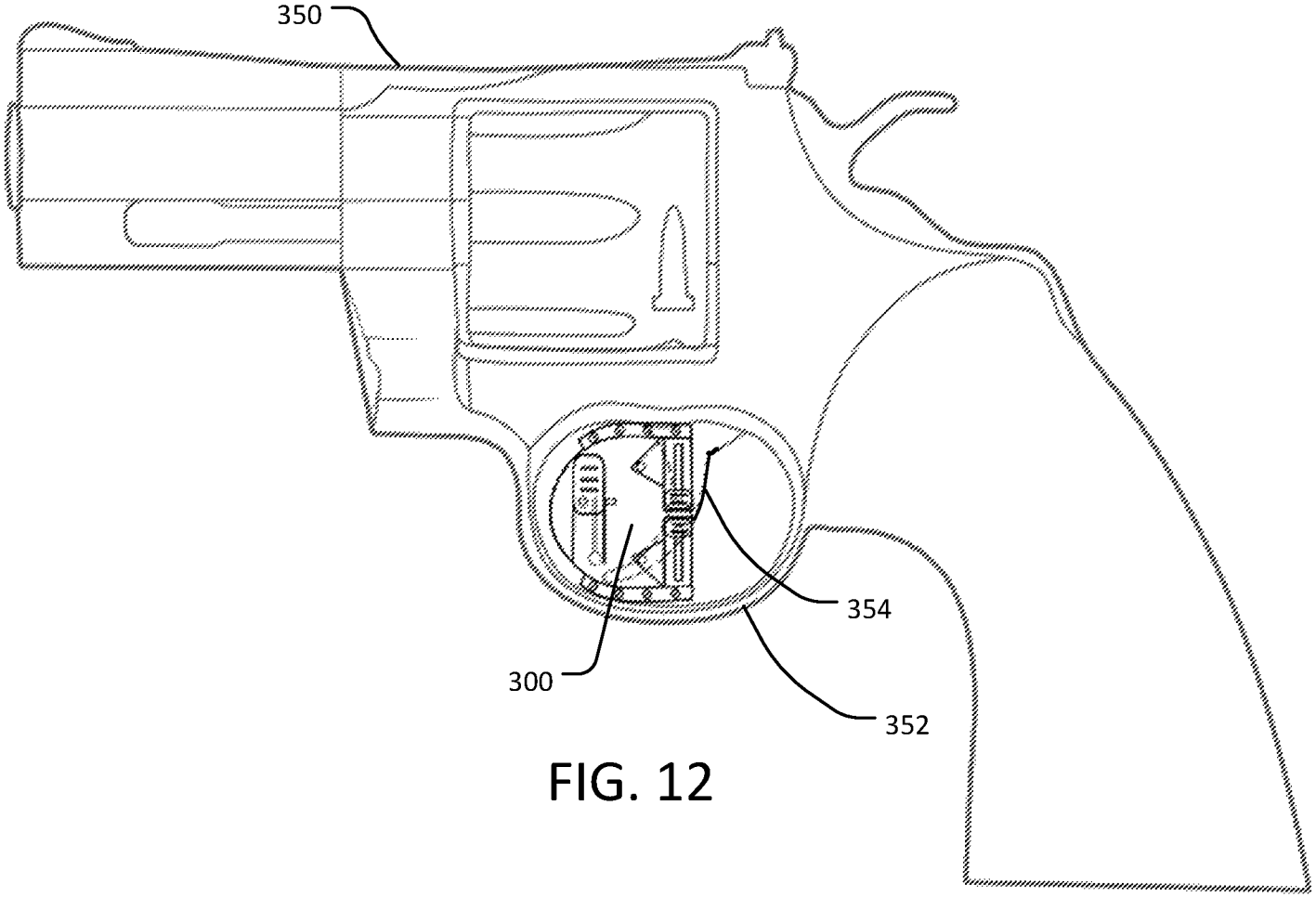
FIG. 12 is a side view of a trigger block installed on a firearm according to one embodiment of the present invention.

Referring to FIG. 12, the slide trigger block 300 is shown installed in a firearm 350. The slide trigger block 300 can be installed in a trigger guard 352 of the firearm 350 and can be implemented to shroud a trigger 354 of the firearm. As shown, the slide trigger block 300 does not impede a movement of the trigger 354 but can be implemented to restrict access to the trigger 354. As previously mentioned, to remove the slide trigger block 300, a user would be required to move the engagement members 310 and overcome the locking pins 312 to allow for the slide trigger block 300 to be removed.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A trigger block for shrouding a trigger in a trigger guard, the trigger block comprising:

a lower frame member;

an upper frame member adapted to slidably couple to the lower frame member; and a ratchet assembly operatively connected to the upper frame member and located partially in the lower frame member, the ratchet assembly adapted to secure the upper frame member in relation to the lower frame member;

wherein (i) the lower frame member and the upper frame member are adapted to shroud the trigger and be located substantially within the trigger guard, and (ii) the ratchet assembly is adapted to be oriented vertically and parallel with the trigger in the trigger guard.

2. The trigger block of claim 1, wherein the ratchet assembly includes a linear rack and a pawl operatively connected to the linear rack.

3. The trigger block of claim 2, wherein the lower frame member includes a stop member adapted to restrict movement of the pawl.

4. The trigger block of claim 1, wherein the lower frame member includes a lower mounting member, a stop member, and a pawl.

5. The trigger block of claim 4, wherein the upper frame member includes an upper mounting member, a locking member, and a linear rack.

6. The trigger block of claim 5, wherein the stop member restricts the pawl until a predetermined force is applied to the pawl to overcome the stop member.

7. The trigger block of claim 4, wherein the upper mounting member is adapted to rise above a top of the upper frame member to engage a firearm and secure the trigger block in place.

8. The trigger block of claim 7, wherein the locking member is adapted to lock the upper mounting member in place.

9. The trigger block of claim 1, wherein the trigger block does not affect an operation of the trigger.

10. A collapsible trigger block comprising:

a linear ratchet assembly including a pawl and a linear rack;

a lower frame member, the pawl being coupled to the lower frame member;

an upper frame member slidably coupled to the lower frame member, the linear rack being coupled to the upper frame member; and a stop member coupled to the lower frame member, the stop member adapted to block a movement of the pawl;

wherein the linear ratchet assembly is adapted to be located entirely within a trigger guard of a firearm.

11. The collapsible trigger block of claim 10, wherein the stop member has a predetermined breaking force.

12. The collapsible trigger block of claim 10, wherein the lower frame member and the upper frame member are adapted to shroud at least a portion of a trigger in a trigger guard.

13. The collapsible trigger block of claim 12, wherein a portion of the trigger guard in front of the trigger remains unblocked when the collapsible trigger block is installed.

14. The collapsible trigger block of claim 10, wherein the linear ratchet assembly fixes the upper frame member in place in relation to the lower frame member.

15. The collapsible trigger block of claim 10, wherein a bottom of the lower frame member is contoured to mate with a trigger guard.

16. The collapsible trigger block of claim 11, wherein the bottom of the lower frame member includes a slip-resistant layer.

17. The collapsible trigger block of claim 10, wherein a top of the upper frame member includes a slip-resistant layer.

18. The collapsible trigger block of claim 10, wherein the pawl is rotatably coupled to the lower frame member.

19. The collapsible trigger block of claim 10, wherein the upper frame member is adapted to slide down into the lower frame member when the pawl disengages from the linear rack.

20. A trigger block for shrouding a trigger in a trigger guard of a firearm, the trigger block comprising:

a linear ratchet assembly including a pawl and a linear rack, the linear rachet assembly adapted to be located entirely within the trigger guard when shrouding the trigger;

a lower frame member, the pawl being rotatably coupled to the lower frame member;

an upper frame member slidably coupled to the lower frame member, the linear rack being coupled to the upper frame member; and a stop member coupled to the lower frame member, the stop member adapted to block a movement of the pawl;

wherein (i) the lower frame member and the upper frame member are adapted to shroud the trigger in the trigger guard; (ii) the stop member has a predetermined breaking force where when exceeded the pawl may move freely; and (iii) the trigger is accessible when the stop member predetermined breaking force is exceeded.

* * * * *